United States Patent [19]

Barthomeuf

[11] Patent Number: 4,967,553

[45] Date of Patent: Nov. 6, 1990

[54] SYSTEM FOR MONITORING A HYDRAULIC ACCUMULATOR

[75] Inventor: Jean-Claude S. Barthomeuf, Anse, France

[73] Assignee: Eimco-Secoma, Societe Anonyme, Meyzieu, France

[21] Appl. No.: 370,898

[22] Filed: Jun. 23, 1989

[30] Foreign Application Priority Data

Jun. 28, 1988 [FR] France ..... 88 09040

[51] Int. Cl.[5] ..... E21B 1/00; F15B 1/04; F15B 19/00

[52] U.S. Cl. ..... 60/371; 60/418

[58] Field of Search ..... 60/418, 371

[56] References Cited

U.S. PATENT DOCUMENTS

| | | | |
|---|---|---|---|
| 3,942,322 | 3/1976 | Hammarstrand | 60/371 |
| 3,963,039 | 6/1976 | Coeurderoy | 60/413 X |
| 4,199,941 | 4/1980 | Farr | 60/413 |
| 4,796,428 | 1/1989 | Hall | 60/418 X |

*Primary Examiner*—Carl D. Price
*Assistant Examiner*—George Kapsalas
*Attorney, Agent, or Firm*—Herbert Dubno; Andrew Wilford

[57] ABSTRACT

A high-pressure source of hydraulic fluid and a sump are connected to a cyclically operating user of hydraulic fluid having a hydraulic accumulator by a high-pressure feed line having one end connected to the source and an opposite end connected to the accumulator and user. A pressure-limiting valve has an input side connected to the high-pressure line between the ends thereof and an opposite output side connected to the sump. This valve opens only when pressure in the line exceeds a preset maximum to allow flow between its sides. A detector is connected to the output side of the valve for measuring the peak pressure thereof over several operating cycles of the user and a controller is connected to the detector for operating when the peak pressure detected over several operating cycles exceeds a predetermined threshold.

8 Claims, 2 Drawing Sheets

SYSTEM FOR MONITORING A HYDRAULIC ACCUMULATOR

BACKGROUND OF THE INVENTION

1. Field of the Invention

The present invention relates to a hydraulic system having a pressure accumulator. More particularly this invention concerns the monitoring of the operation of an accumulator associated with a percussion hammer.

2. Description of the Prior Art

It is standard to power a periodically operating hydraulic tool, for instance a percussion hammer used in a mining operation, from a pump source that supplies liquid at a generally constant pressure and/or volume whose average rate is sufficient to operate the tool but which lies well below the peak rate the tool consumes. For instance the percussion hammer consumes a substantial amount of hydraulic fluid on its forward stroke and on its return stroke only a little. Accordingly it is standard to connect a pressure accumulator to the pressure user to store up the fluid during the part of the cycle when consumption is low and feed it to the user during the part of the cycle when consumption is high.

Thus as seen in FIG. 1 where volume D is plotted on the ordinate and time t on the abscissa, a supply pump produces a constant output Do. The user, however, consumes fluid at a rate shown by the square-wave trace t that lies wholly above the abscissa and that is roughly bisected by the line of output Do. During the cycle halves QA of low consumption the accumulator stores up the fluid from the pump, and during the high-consumption cycle halves QR it feeds this fluid to the user.

The accumulator typically is formed as a substantially closed chamber subdivided by an impermeable but flexible membrane into a compartment that is pressurized with an inert gas, typically nitrogen, at superatmospheric pressure, and a compartment that is connected to the conduit between the pump and the user. When the accumulator becomes damaged or for some reason—leakage, improper filling, valve failure—loses pressure, the effect on the tool is often extremely damaging in that hydraulic shocks that are propagated in the tool and lines that can easily lead to mechanical failure. Unfortunately in the case of a hydraulic percussion hammer used for mining such failure is not rare and is often not noticed immediately because the hammer itself is carried on an arm extending some distance from the tractor and is therefore at some distance from the operator of the machine.

It has been suggested to provide a pressure sensor on the accumulator, typically mounted right on the hammer, and to connect it via a hydraulic or electric line back to a warning device at the operator's station. This solution just adds to the complexity of the piece of equipment and requires that yet another carefully shielded line be extended from the operator to the tool.

Summary of the Invention

It is therefore an object of the present invention to provide an improved system for monitoring a hydraulic accumulator.

Another object is the provision of such an improved system for monitoring a hydraulic accumulator which overcomes the above-given disadvantages, that is which gives a clear indication of any failure of the accumulator while not adding significantly to the complexity of the equipment.

A further object is to provide an accumulator-monitoring system which can function from the operator end of the system where the pump is and which can even be used to watch over several accumulators.

The instant invention is used in combination with a high-pressure source of hydraulic fluid, a sump, a cyclically operating user of hydraulic fluid, a hydraulic accumulator at the user, a high-pressure feed line having one end connected to the source and an opposite end connected to the accumulator and user, and a pressure-limiting valve having an input side connected to the high-pressure line between the ends thereof and an opposite output side connected to the sump. This valve opens only when pressure in the line exceeds a preset maximum to allow flow between its sides. According to this invention a detector is connected to the output side of the valve for measuring the peak pressure thereof over several operating cycles of the user and a controller is connected to the detector for operating when the peak pressure detected over several operating cycles exceeds a predetermined threshold.

The invention recognizes that under normal operating circumstances the pressure-limiting valve of such a tool, for instance a mining-type drilling hammer, passes a small amount of fluid with each stroke of the operating hammer. When, however, the gas pressurization of the accumulator fails the pressure of the amount of fluid passed increases significantly, but for only an extremely brief instant. In fact the total volume passed by the pressure-limiting valve when the accumulator is out of order will only slightly exceed that passed when it is working properly, and the pressure peak will be so very short as to be virtually impossible to measure. The instant invention, however, captures these peaks and adds them together over several cycles to determine whether or not the accumulator is malfunctioning. Not only does this procedure allow the detector to determine when the accumulator is damaged or malfunctioning, but it allows it to distinguish such a situation from a momentary pressure peak caused, for instance, when the drill gets jammed.

More particularly according to this invention a drain conduit connects the output side to the sump and the detector includes a restriction in the drain conduit, a pressurizable compartment, a branch line having one end connected to the drain conduit between the restriction and the output side and an opposite end opening into the compartment check valve between the compartment and the opposite end of the branch line permitting fluid flow substantially only into the compartment, and means for measuring the volume of hydraulic fluid in the compartment.

According to another feature of this invention the means for measuring includes a switch actuatable when the volume of fluid in the compartment exceeds a predetermined limit. The control means includes an alarm activated when the switch is actuated and can even be connected to the source to stop same when the switch is actuated.

The user and accumulator according to this invention are situated at some distance from the source, sump, valve, and both the detector and controller. There is no need of a separate pilot line or the like extending to the outboard tool in order to monitor the accumulator which invariably is mounted right on it.

BRIEF DESCRIPTION OF THE DRAWINGS

The instant invention and prior art are described with reference to the accompanying drawings in which.

DETAILED DESCRIPTION OF THE PREFERRED EMBODIMENTS

Figure 2:
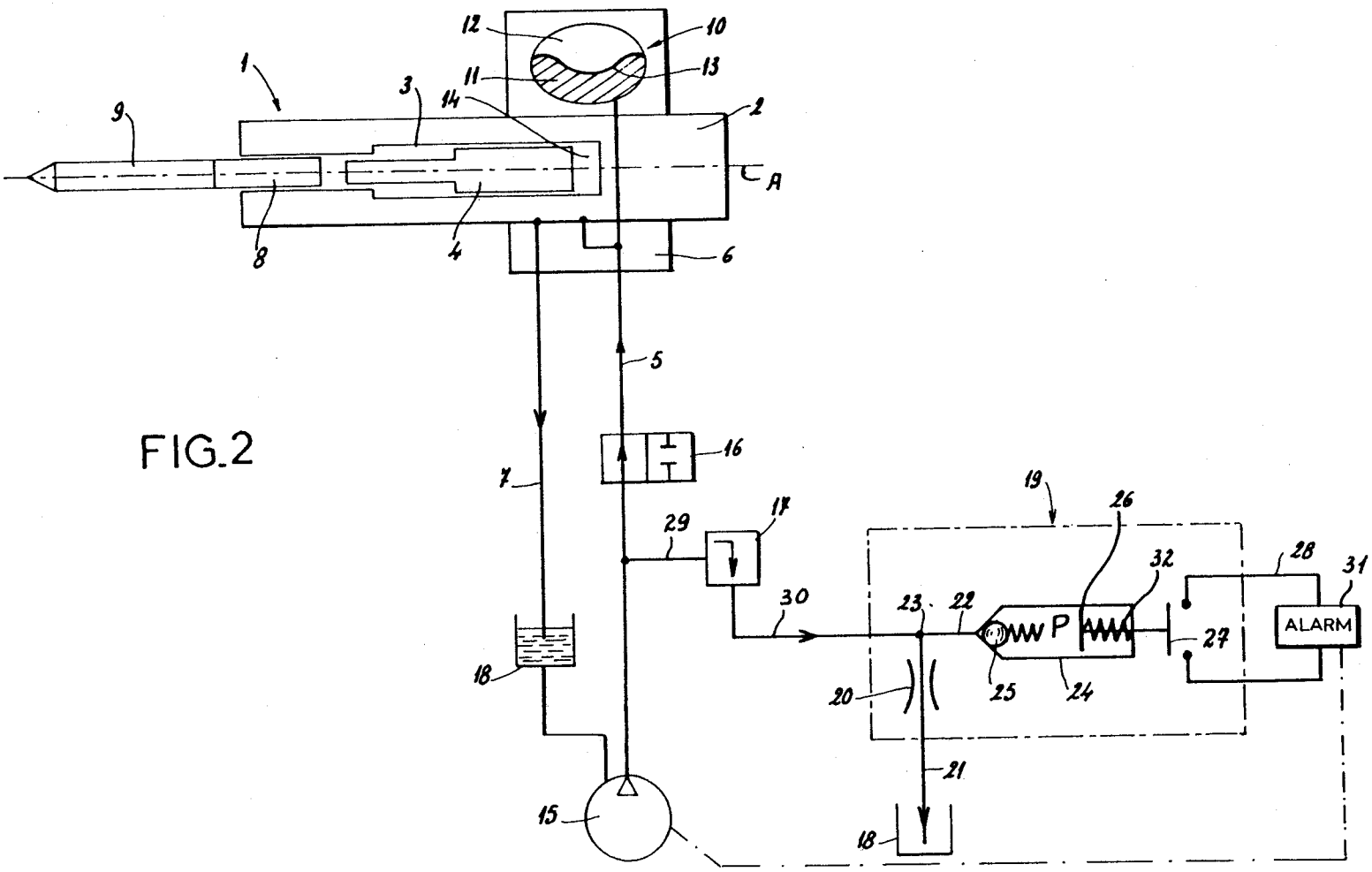
FIG. 2 is a schematic diagram of the accumulator-monitoring system of this invention.

As seen in FIG. 2 a hydraulic percussion hammer 1 such as described in U.S. Pat. No. 4,899,836 has a housing 2 forming a cylinder chamber 3 in which a hammer 4 is reciprocal along an axis A. A high-pressure feed line 5 supplies hydraulic fluid to a control valve 6 of the tool 1 and a low-pressure line 7 returns the fluid to a sump 18. The piston 4 can strike a rear end 8 of a boring tool 9 on its forward stroke, when a compartment 14 behind the piston 14 is pressurized.

The housing 1 carries an accumulator 10 having an oil-filled compartment 11 and an air-filled compartment 12 separated by an impermeable membrane 13. The compartment 11 is permanently connected to the input line 5 and periodically is connected to the back compartment 14 of the cylinder 3 by the valve 6.

A pressure source, here a pump 15, has its output connected to the feed line 5 and its intake to the sump 18. A main shutoff valve 16 is provided in the line 5 between the pump 15 and the valve 6 and a pressure-limiting valve 17 of standard construction is connected via an intake line 29 to the feed line 5 upstream of the valve 16 and via a output lines 21 and 30 to the sump 18. This valve 17 opens when the pressure in the line 5 exceeds a predetermined limit, feeding the excess liquid to the sump 18. As a rule the pump 15 and valves 16 and 17 along with the sump 18 are provided together and somewhat remote from the tool 1, with only the lines 5 and 7 extending to the tool 1 and accumulator 10

According to the instant invention a malfunction detector 19 has a restriction 20 in the downstream drain or output line 21. A branch line 22 extending from an intersection 23 between the lines 21 and 30 feeds the pressure in the line 30 upstream of the restriction 20 to a substantially closed chamber 24 provided at its inlet with a check-valve ball 25 and also provided with a piston-type actuator 26 braced against a spring 32 and operating a switch 27 itself connected via an electric line 28 to an alarm 31. This detector 19 and the alarm 31 are both provided at the operator end of the system, that is along with the pump 15 and valves 16 and 17.

Figure 1:
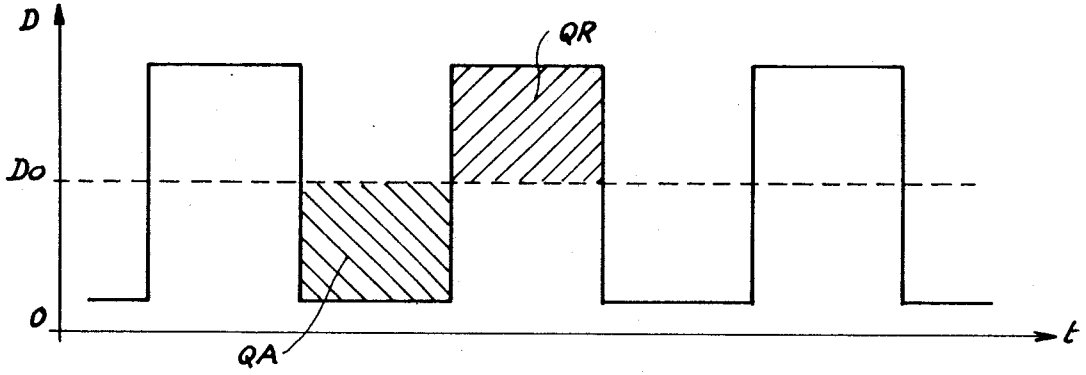
FIG. 1 is a graph illustrating the operation of an accumulator connected to a percussion hammer.
Figure 3:
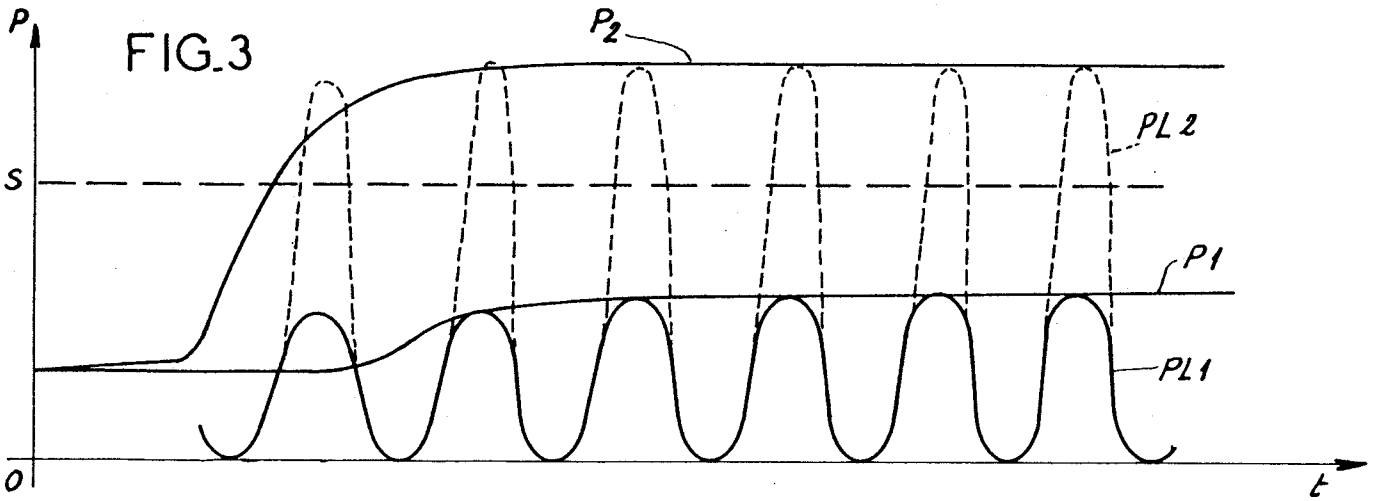
FIG. 3 is a graph illustrating how the system of FIG. 2 works.

This detector system 19 serves to detect when pressurization of the chamber 12 fails. Thus as seen in FIG. 3 where the pressure P in the chamber 24 is plotted on the ordinate and time t on the abscissa, it being assumed that the hammer 1 is started at t=0, under normal circumstances the valve 17 will open slightly with each operation of the tool 1, delivering small pressure peaks defining a curve PL1 to the line 22. The restriction 20 is dimensioned such that this pressure can bleed off completely between succeeding peaks. This will pressurize the chamber 24 as shown by line Pl. The pressure Pl is insufficient to compress the spring 32, so that the switch 27 will not be closed.

On the contrary, when the buffering effect of the gas in the compartment 12 is lost the pressure peaks will be much greater and will define a curve PL2 having much higher peaks, so that the chamber 24 is momentarily pressurized at a very high pressure P2 exceeding a threshold level S determined by the force of the spring 32. The piston 24 moves slightly to the right as seen in FIG. 2, that is in a direction closing the switch 27, each time the compartment 24 is pressurized at a pressure greater than the threshold level S. In addition with each such pressurization the extra volume added to the compartment 24 is trapped therein by the valve 23, so that the piston 26 will be indexed slightly to the right with each such pressurization at a pressure greater than threshold S. The switch 27 closes when the volume in the compartment 24 has been increased sufficiently by consecutive pressurizations at pressures greater than S. When this switch 27 is actuated, here closed, it automatically operates the alarm 31 and shuts off the pump 15.

Once the alarm 31 is actuated the system is reset either by operating a not illustrated vent that bleeds the contents of the chamber 24 to the sump 18, or the system is constructed with to allow a tiny bit of leakage back past the ball 25 so it will slowly reset itself, any such leakage being of course insufficient to allow the fluid introduced into the chamber 24 by one of the peaks of the curve PL2 to flow out completely before the next such peak.

The system of this invention is not limited to use with a particular type of tool or even to use with a single tool. Indeed it can be coupled to a pump feeding a plurality of tools or other hydraulic users having respective accumulators and can be set up to respond if any of them fails. The alarm could operate hydraulically or even pneumatically, and an electric system, for instance a strain-gauge pressure detector coupled to an integrator, could be used to detect excessive drainage from the pressure limiting valve 17. In addition this arrangement will work equally well with accumulators of different construction, for instance piston-type accumulators.

I claim:

1. In combination with:

a high-pressure source of hydraulic fluid;

a sump;

a cyclically operating user of hydraulic fluid;

a hydraulic accumulator at the user;

a high-pressure feed line having one end connected to the source and an opposite end connected to the accumulator and user; and a pressure-limiting valve having an input side connected to the high-pressure line between the ends thereof and an opposite output side connected to the sump, the valve opening only when pressure in the line exceeds a preset maximum to allow flow between its sides; the improvement comprising:

detector means connected to the output side of the valve for measuring the peak pressure thereof over several operating cycles of the user; and control means connected to the detector means for operating when the peak pressure detected over several operating cycles exceeds a predetermined threshold.

2. The combination defined in claim 1, further comprising a drain conduit connecting the output side to the sump, the detector means including a restriction in the drain conduit, a pressurizable compartment, a branch line having one end connected to the drain conduit between the restriction and the output side and an opposite end opening into the compartment, a check valve between the compartment and the opposite end of the branch line permitting fluid flow substantially only into the compartment, and means for measuring the volume of hydraulic fluid in the compartment.

3. The combination defined in claim 2 wherein the means for measuring includes a switch actuatable when the volume of fluid in the compartment exceeds a predetermined limit.

4. The combination defined in claim 3 wherein the control means includes an alarm activated when the switch is actuated.

5. The combination defined in claim 3 wherein the control means is connected to the source to stop same when the switch is actuated.

6. The combination defined in claim 1 wherein the user and accumulator are situated at some distance from the source, sump, valve, and both means.

7. The combination defined in claim 1 wherein the user is a hydraulic percussion hammer.

8. In combination with:

a high-pressure source of hydraulic fluid having an output at a generally constant intermediate pressure;

a sump;

a cyclically operating user of hydraulic fluid;

a hydraulic accumulator at the user;

a high-pressure feed line having one end connected to the output of the source and an opposite end connected to the accumulator and user;

a pressure-limiting valve having an input side connected to the high-pressure line between the ends thereof and an opposite output side, the valve opening only when pressure in the line exceeds a preset maximum to allow flow between its sides; and a drain conduit connected between the output side and the sump;

the improvement comprising:

a restriction in the drain conduit, a pressurizable compartment, a branch line having one end connected to the drain conduit between the restriction and the output side and an opposite end opening into the compartment, a check valve connected between the compartment and the opposite end of the branch line and only permitting fluid flow into the compartment, and switch means actuatable when the volume in the compartment exceeds a predetermined threshold.

* * * * *